US005878639A

United States Patent [19]

Martinez

[11] Patent Number: 5,878,639

[45] Date of Patent: Mar. 9, 1999

[54] WALL SURFACE CUTTING AND REPAIRING APPARATUS AND METHOD

[76] Inventor: Antonio Armando Murua Martinez, 19691 Sun Cir., West Linn, Oreg. 97068

[21] Appl. No.: 699,656

[22] Filed: Aug. 19, 1996

Related U.S. Application Data

[63] Continuation of Ser. No. 246,780, May 20, 1994.

[51] Int. Cl.[6] ..... B26D 1/42

[52] U.S. Cl. ..... 83/13; 52/742.12; 83/581; 83/592; 83/745

[58] Field of Search ..... 83/745, 592, 581, 83/13, 56; 30/310; 52/742.12; 408/102, 137

[56] References Cited

U.S. PATENT DOCUMENTS

| | | | |
|---|---|---|---|
| 669,555 | 3/1901 | Simpson | 30/310 |
| 701,828 | 6/1902 | Arnold . | |
| 1,299,688 | 4/1919 | De Long | 408/102 |
| 2,311,234 | 2/1943 | Krajnc . | |
| 2,450,469 | 10/1948 | De Martin . | |
| 2,468,504 | 4/1949 | Little . | |
| 2,546,292 | 3/1951 | Bell . | |
| 2,573,462 | 10/1951 | Lindsey . | |
| 3,180,380 | 4/1965 | Franzen . | |
| 3,383,766 | 5/1968 | Hummert . | |
| 4,044,464 | 8/1977 | Schiess et al. . | |
| 4,060,893 | 12/1977 | Matsurra . | |
| 4,222,169 | 9/1980 | Lockwood | 30/310 |
| 4,548,118 | 10/1985 | Brosch | 30/310 |
| 4,620,407 | 11/1986 | Schmid . | |
| 4,773,798 | 9/1988 | Gaster et al. | 30/310 |
| 4,858,322 | 8/1989 | Kluga . | |
| 4,961,799 | 10/1990 | Cologna et al. . | |
| 5,058,273 | 10/1991 | Streger . | |
| 5,065,517 | 11/1991 | Markes | 30/310 |
| 5,117,605 | 6/1992 | Waldbeiser . | |
| 5,199,238 | 4/1993 | Maestas . | |
| 5,233,748 | 8/1993 | Logan et al. | 30/310 |
| 5,269,861 | 12/1993 | Gilbreath . | |
| 5,317,808 | 6/1994 | Garlitz | 30/310 |
| 5,430,946 | 7/1995 | Peters et al. . | |
| 5,596,809 | 1/1997 | Beard | 30/310 |

*Primary Examiner*—Kenneth E. Peterson
*Attorney, Agent, or Firm*—Klarquist Sparkman Campbell Leigh & Whinston, LLP

[57] ABSTRACT

A cutting apparatus in one form comprises a base attachable to one surface of a sheet of drywall or the like. An elongate blade assembly is rotatably attached to the base to permit blade assembly rotation along the drywall. A cutting blade is attached to the distal end of the support member to cut into the drywall along a circular profile as the blade assembly is rotated. An advancer interconnects the base and the blade assembly along which the blade is advanced deeper into the drywall sheet as the blade assembly is rotated. The advancer may be a threaded shaft extending from the base onto which the blade assembly is rotatably threaded, so that the progressive advancement is proportional to the rotation of the blade assembly.

18 Claims, 2 Drawing Sheets

FIG. 1
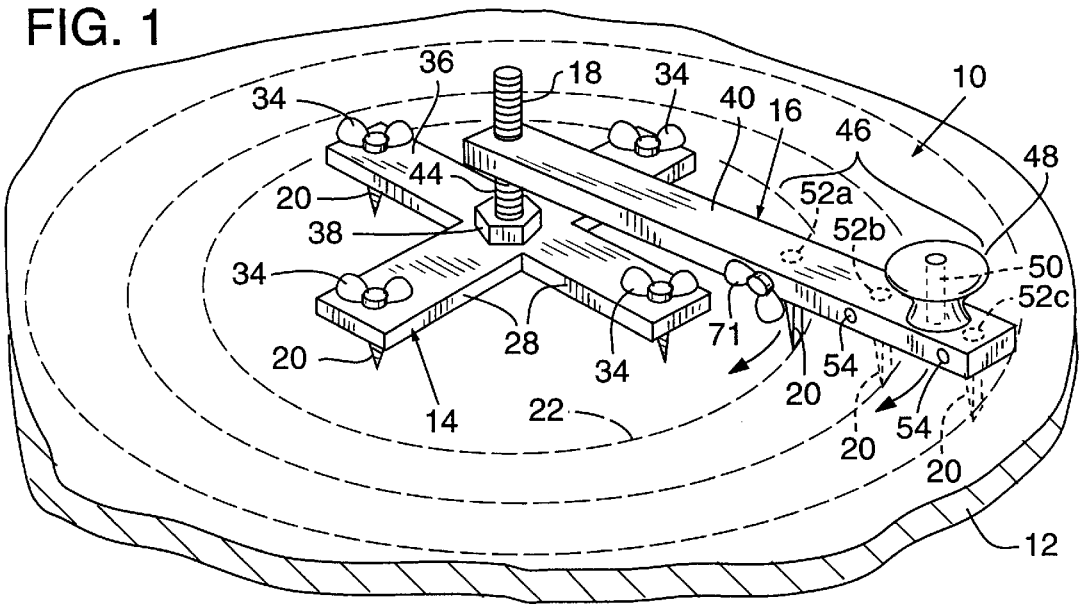
FIG. 2
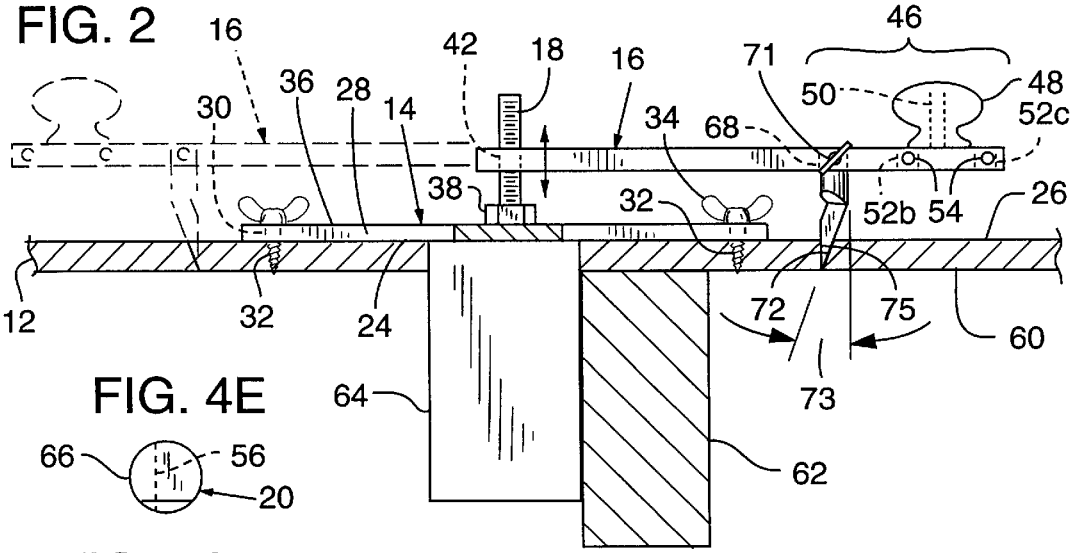
FIG. 4E
FIG. 4A
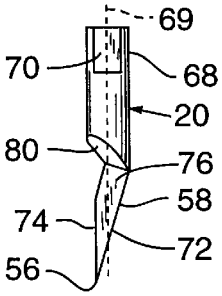
FIG. 4B
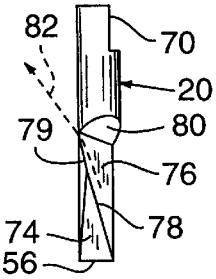
FIG. 4C
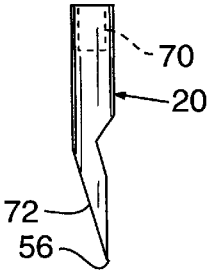
FIG. 4D
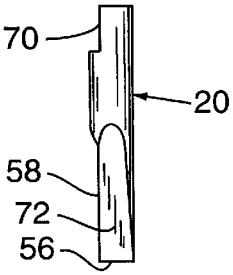

WALL SURFACE CUTTING AND REPAIRING APPARATUS AND METHOD

This is a continuation, of application No. 08/246,780, filed May 20, 1994, pending.

FIELD OF THE INVENTION

The present invention is directed to apparatus and method for cutting holes into sheets of wall surface material mounted to the framework or other underwall surface structure of a building. In particular, the present invention has specific applicability to repair of drywall. It should be noted that the term "wall" as used in this application is meant broadly to include upright surfaces (e.g. traditional walls), horizontal or transverse surfaces (e.g. ceiling) and other surfaces.

BACKGROUND OF THE INVENTION

Drywall, also known as sheetrock, is widely used in the construction of interior building walls. Drywall is typically comprised of a layer of gypsum sandwiched between two layers of tough cover paper. Sheets of drywall may be permanently fastened directly to a frame comprised of wall studs or other underwall surface structures to provide smooth wall surfaces. In such construction, drywall sheets are commonly positioned over light switches and other electrical fixtures, as well as ventilation ducts in the like with openings provided in the drywall to receive these components.

Access holes are often required in installed drywall for wiring projects, to reach concealed building components (e.g. pipes) and for installation of equipment, such as additional light fixtures or stereo speakers. Moreover, localized damage to drywall often requires that the damaged portion be cut out and patched.

Cutting holes in drywall has been somewhat problematic. Hand-held saws are often used for this purpose, but are undesirable since such saw blades are designed to reciprocate back and forth while extending completely through the drywall. Thus, the saw blade reciprocation may be impeded by underlying wall studs. Moreover, the saw blade may protrude through the drywall and cut into electrical equipment, risking injury to the saw user or damage to the equipment.

To patch holes in drywall, thin metal or plastic patches are often placed in the holes and covered with spackle. Such patched areas tend to lack the structural integrity of unpatched drywall.

A need exists for an improved apparatus and method for cutting holes in sheets of drywall which overcomes these and other disadvantages of the prior art.

SUMMARY OF THE INVENTION

It is one object of the present invention to provide an improved cutting apparatus and method for cutting holes in sheets of wall surface material such as drywall without the apparatus substantially protruding from an opposite surfaces of the drywall sheets.

A secondary object of the present invention is to provide an apparatus and method that cuts uniform sized holes in sheets of drywall.

It is another object of the present invention to provide an apparatus and method which progressively advances the cutting apparatus through the sheet of drywall.

Yet another object of the present invention is to provide a cutting apparatus and method that continuously sheds substantially all drywall particles produced during cutting of the drywall.

One more object of the present invention is to provide a cutting apparatus and method that is convenient and efficient to use.

Another object of the present invention is to provide an improved method of cutting and repairing damaged areas in wall surface materials.

Yet another object is to provide an improved wall surface cutting blade. A further object is to provide improved wall surface patches.

An apparatus in accordance with one aspect of the present invention comprises a base attachable to one surface of the sheet of drywall, with an elongate blade assembly movably attached to the base to permit blade assembly movement along the drywall. The blade assembly is preferably rotatably attached to the base to permit blade assembly rotation along the drywall. A cutting blade is attached to the distal end of the blade assembly to cut into the drywall along a circular profile as the blade assembly is rotated. An advancer interconnects the base and the blade assembly to progressively advance the blade deeper into the sheet of drywall as the member is rotated. The progressive advancement into the drywall is proportional to the rotation of the blade assembly. Preferably, the advancer is a threaded shaft extending from the base onto which the blade assembly is rotatably threaded.

A preferred cutting method comprises attaching a base to one surface of the drywall, and rotatably mounting a blade support member on the base. The blade support member has a blade extending from a distal end thereof to engage the drywall surface. The member is rotated so that the blade cuts into the drywall along a circular contour. The blade is progressively advanced in a helical path into the sheet of drywall. Once the drywall sheet is completely cut through, a scrap of drywall is pulled away from within the cut circular profile to form a circular hole in the drywall. A plug made of drywall may then be inserted into the hole to patch the drywall.

The present invention relates to the above objects, features and advantages individually as well as collectively. Additional objects, features and advantages of the present invention will become apparent with reference to the following description and drawings.

BRIEF DESCRIPTION OF THE DRAWINGS

FIG. 1 is a perspective view of a cutting apparatus in accordance with an embodiment of the present invention, the cutting apparatus shown attached to a sheet of drywall, and the dashed lines showing variable circular contours cutable by the apparatus.

FIG. 2 is a side view of the cutting apparatus, showing the apparatus cutting the drywall, with the dashed portion of the apparatus illustrating the rotation of an apparatus blade assembly.

FIG. 4A is an elevational front view of a cutting tool shown FIGS. 1 and 2.

FIG. 4B is a side elevational view of the cutting tool shown in FIG. 4A, showing the in-board side of the tool.

FIG. 4C is a rear elevational view of the cutting tool shown in FIG. 4A.

FIG. 4D is a side elevational view of the cutting tool shown in FIG. 4A, showing an outboard side of the tool.

FIG. 4E is a top plan view of the cutting tool shown in FIG. 4A.

DESCRIPTION OF A PREFERRED EMBODIMENT

Figure 3:
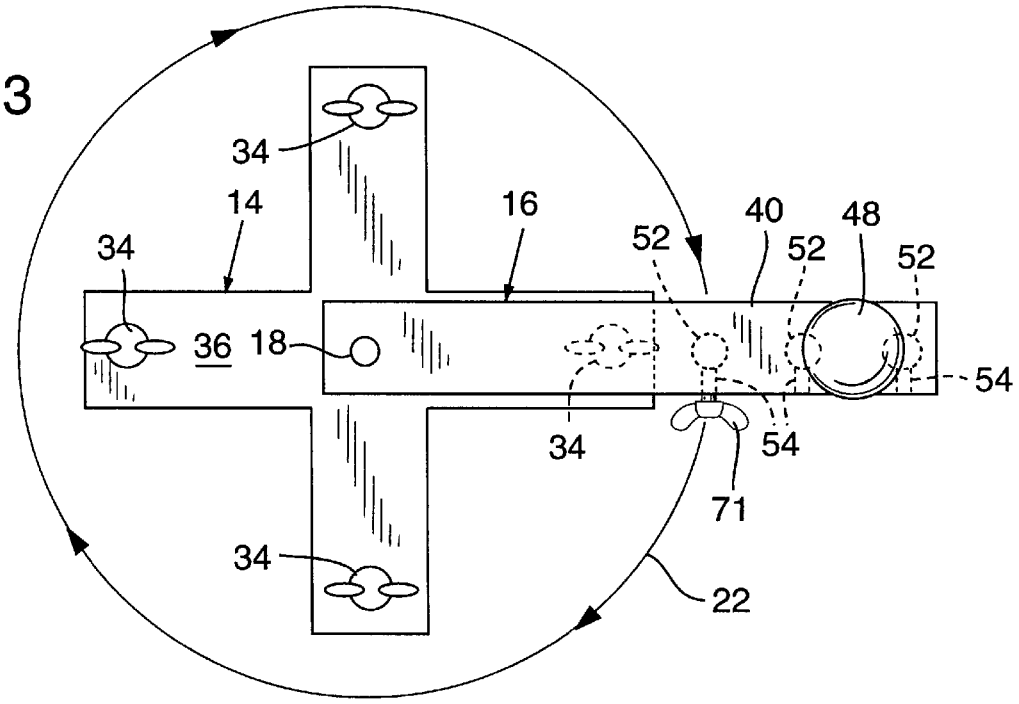
FIG. 3 is a top plan view taken along line 3—3 of FIG. 2.

For purposes of convenience, and not to be construed as a limitation, the detailed description proceeds with reference to drywall, it being understood that the invention is applicable to other wall surface materials as well, although the primary applicability of the cutter is to soften surfaces such as of plaster, fibrous materials and the like, in addition to drywall.

An illustrated embodiment of an apparatus 10 for cutting holes in sheets of drywall material 12 is generally shown in FIG. 1. The apparatus generally comprises a base 14 that is detachably movable or fixable to a portion of drywall to be patched. A blade assembly 16 is rotatably attached to the base by a threaded advancer shaft 18. As the blade assembly 16 is rotated, a cutting tool, or blade 20 extending from the blade assembly progresses through a helical cutting path to cut a circular hole 21 (see FIG. 5) in the drywall.

Throughout the following detailed description, positions closer to the drywall will be referred to as inward, while positions away from the wall will be referred to as outward.

As shown in FIG. 2, the apparatus base 10 has an inward side 24 that is adaptable for attachment to an exposed surface 26 of the drywall. In the preferred embodiment, the base 24 is formed from two leg members 28 interconnected in a cross shape. Attachment apertures 30 in the distal ends of the legs receive screws 32 for temporarily mounting the base to the sheet of drywall. Preferably the screws 32 are drywall screws with winged heads 34 for convenient manual threading into the drywall.

The screws 32 of the illustrated embodiment are freely detachable from the base 14. It is to be understood that the screws could also be permanently attached to the base. For instance, the screws could be rotatably held within compressible coil springs which are mounted over the attachment apertures. The springs would compress as the screws are threaded into the drywall. Moreover, other attachment means, such as suction cups or adhesives may be used for fastening the base. The base, such as is illustrated in FIG. 1, may be attached to the wall surface material at plural spaced locations. By engaging or coupling the base to the wall surface material at spaced locations, the base is non-rotatable relative to the wall surface material when in place. In the FIG. 1 form, the base is mounted to the wall surface material at four locations, each spaced from the pivot axis about which an arm 40 pivots or rotates as explained below.

As best shown in FIGS. 1–3, the illustrated form of advancer shaft 18 extends perpendicularly from center of the upper surface 36 of the base 14. The shaft may be a conventional threaded steel shaft. The shaft may be threadedly mounted to the base at a threaded shaft aperture defined in the base. To fix the shaft 18 to the base, a lock nut 38, held on the shaft is threaded into snug engagement with the base upper surface 36. The shaft may be secured to the base in any convenient manner, such as being welded to the base, or cast with the base.

The blade assembly 16 includes a blade support member, such as elongate arm 40. One end of the arm 40 has a threaded shaft aperture 42 to permit the arm to be threaded onto the threaded shaft 18. Such threaded connection permits the arm 40 to be rotated about the shaft. As the arm is rotated, the sloped surfaces 44 of the shaft threads shift the arm axially along the shaft 18.

The advancer may take other forms as well. For example, the arm may simply slide along the shaft as the user applies downward pressure on the blade. Preferably, however, the illustrated advancer permits axial shifting of the blade support along the shaft.

As shown in FIG. 2, the arm 40 remains parallel with the plane defined by the drywall outer surface 26 while the arm rotates. A distal portion 46 of the arm extending laterally beyond the diameter of the base 14 supports the cutting tool (blade) 20 to permit the cutting of the drywall during arm rotation. A rotatable knob 48 is distally mounted to the upper surface of the arm to facilitate rotation of the arm by a user of the cutter apparatus. The knob is rotatably mounted on a knob shaft 50 extending from the top of the arm 40.

As shown in FIGS. 1–3, the cutting tool 20 extends perpendicularly from the lower surface of the arm distal portion 46. The tool 20 traces out the circular cutting contour 22 on the sheet of drywall as the arm 40 is rotated. A series, in this case three, of tool mounting apertures 52*a*, 52*b*, 52*c* are provided at selected positions along the lower surface of the arm distal portion. The cutting tool 20 may be mounted in any of the apertures to permit the selection of the circular contour diameter traced out by the cutting tool. Lock screw apertures 54 extend from a side surface of the arm 40 to interconnect with each of the mounting apertures 52*a*–52*c*.

The cutting tool 20 is shown mounted in inboard-most aperture 52*a*. Bases 14 of larger cross-sections (e.g. diameters) may optionally be used when the cutting tool 20 is mounted in respective outboard mounting apertures 52*b*, 52*c*. Moreover, instead of the series of mounting apertures 52*a*–52*c*, the arm may have a longitudinal slot in which the cutting tool may be mounted for slidable adjustment with the cutting tool being clamped or otherwise secured in place after it is moved to the desired position.

The cutting tool 20 may take any convenient form, such as a straight blade or other configuration. However, an illustrated preferred form of cutting tool has a leading cutting edge 56 and a bevel cutting edge 58, as described in greater detail below, to cut a beveled hole in the drywall. The threaded attachment of the arm 40 on the advancer shaft 18 causes the cutting edges 56, 58 move through a helical cutting path through the drywall as the arm is rotated. The helical path has a radius generally equal to the distance between the advancer shaft 18 axis and the position of the cutting tool 20 mounting within the arm 16. The helical path diameter is equal to the diameter of the circular cutting profile. The spacing between neighboring coils of the helical path is equal to the axial spacing between neighboring threads 44 on the threaded shaft 18, which is preferably about 1/24 of an inch. The axial advancement of the arm in FIG. 2 (compare the axial positions of the dashed arm 16 and the 180 degree rotated solid arm 16) represents one-half the axial advancement of one entire rotation of the arm.

The constrained movement of the tool cutting edges 56, 58 through the helical path results in the axial component of the helical advancement (i.e., the motion perpendicular into the sheet of drywall) being proportional to the angular rotation of the arm about the shaft 18.

Figure 5:
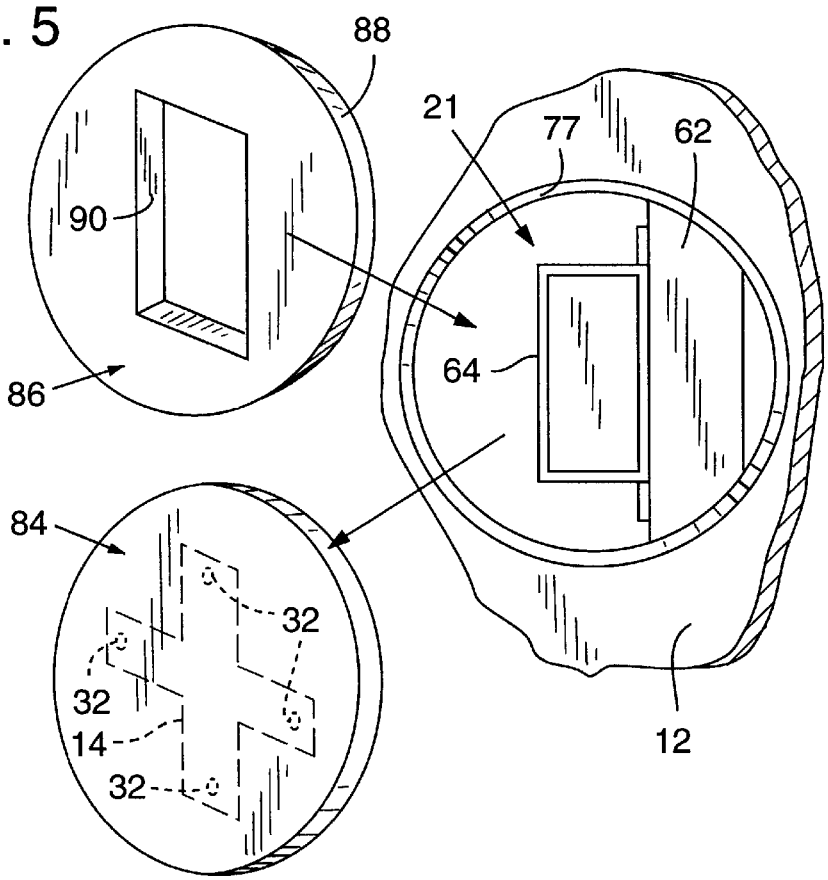
FIG. 5 is a perspective view of a hole cut by the apparatus of the present invention, showing a plug designed to patch the hole.

In the preferred embodiment, the extension of the tool 20 from the arm 16, and the lock nut 38 position on the advancer shaft 18 are such that the tool blades 56, 58 will cut through a standard thickness of drywall without substantial protrusion of the tool 20 from the opposite surface of the drywall sheet (see FIG. 2). In other words, the arm 40 impinges on the lock nut 38 once the arm has advanced the tool 20 to a depth adequate for cleanly cutting through the sheet of drywall. As shown in FIGS. 2 and 5, such tool advancement limiting permits holes to be cut in drywall sheets without cutting underlying materials, such as wall studs 62 or electrical wires. Specifically, in FIG. 2, the tool 20 will cleanly cut through the drywall 12 without cutting or being impeded by the underlying wooden stud 62.

A stop or limiter may be provided to limit the advancement of the tool 20 into the wall. For instance, in FIG. 1, if the shaft is fixed to the base 14 through welding or the like, and the lock nut 38 is freely threadable along the shaft 18, the lock nut may be positioned to limit the extent to which the cutter blade penetrates the wall. The maximum penetration may be set to match the thickness of a particular sheet of drywall. Other adjustable limiters may be provided, such as spacers of selected heights that are placed about the shaft 18 to impinge on the arm 40 once the tool 20 has advanced to a selected depth.

The illustrated cutting tool 20 will now be described. The illustrated tool is a blade which is generally cylindrical with a circular cross-sectional profile 66 (see FIG. 4E). As shown in FIGS. 2 and 4A, an upper end portion 68 of the tool 20 is received within the mounting aperture 52*a*. A flat, axial mounting surface 70 for orienting the tool within the aperture may be cut into the tool upper end portion. The tool 20 is inserted into one of the mounting apertures 52*a*–52*c* and angularly positioned within the aperture such that the flat mounting surface 70 faces the associated mounting screw aperture 54. A lock screw 71 is threaded into the lock screw aperture 54 to engage the flat mounting surface 70 of the cutting tool 20. The lock screw 71 locks the tool in the angular position within the arm 40. The lock screw 71 preferably has a winged head to permit convenient manual tightening (see FIG. 1), and a flat distal end to securely mate with the tool mounting surface.

As will now be described in relation to FIGS. 4A–4D, the cutting tool 20 is configured to cut a beveled hole in the drywall while shedding particles of drywall generated during the cutting of the hole. In the following, the side of the tool 20 oriented toward the center of the circular cutting contour will be described as inboard (FIG. 4B), and the tool side oriented away from the cutting contour will be described as outboard (FIG. 4D). The tool will also be described in terms of a leading side (FIG. 4A) and a trailing side (FIG. 4C).

As shown in FIGS. 4A–4E, the leading cutting edge 56 is positioned on the distal end of the cutting tool 20. As shown in FIGS. 4A and 4E, the leading cutting edge extends laterally across the tool circular profile 66, substantially perpendicular to the axis 69 of the cylindrical tool 20. The leading edge 56 is oriented perpendicular to the plane of the flat mounting surface 70, and perpendicular to the length of the arm 16 when the tool is installed in the mounting aperture 52*a*. So positioned, the leading edge defines the circular cutting contour 22 as the arm 16 is rotated.

The leading cutting edge 56 is formed at the intersection of an outboard bevel surface 72 (FIG. 4D), and an inboard vertical blade surface 74 (FIG. 4B). As shown in FIG. 4A, the bevel and vertical surfaces 72, 74 meet such that the leading edge 56 is offset slightly inboard from a line bisecting the tool profile. The bevel surface is planar and cut into the cylindrical tool 20 to extend at about a 10–15 degree bevel angle 73 from the cylinder axis 69. The bevel surface 72 extends across more than one-half the thickness of the tool cylinder, to yield the inboard offset of the leading edge 56. The vertical blade surface 74 is a planar, axially oriented surface cut into the inboard side of the cylindrical tool 20. As shown in FIG. 4B, the vertical blade surface 74 has a tall, narrow triangular shape, with the blade leading edge 56 representing the triangle base. It is to be understood that the bevel angle 73 may increase as the cross-sectional thickness of the cutting tool 20 increases.

The bevel cutting edge 58 located on the leading side of the tool 20 shown in FIG. 4A. The bevel edge 58 is formed at the intersection of the outboard bevel surface 72 and an inboard shedding surface 76, and is sloped at the bevel angle. The bevel edge 58 is contiguous with the leading edge 56 at a 90 degree corner intersection.

As shown in FIGS. 2 and 4A, the leading profile of the vertical blade surface 74 and the bevel surface 72 defines the shape of the beveled cut along the circular cutting contour 22 shown in FIG. 1. In other words, the tool 20 cuts a beveled groove 75 along the circular cutting profile 22, with the groove having an outward bevel 77 (see FIGS. 2 and 5) oriented at the above bevel angle 73.

As best shown in FIGS. 4A and 4B, the shedding surface 76 is planar and trails diagonally inboard from the bevel edge 58. As best shown in FIG. 4B, the shedding surface 76 generally has the shape of a narrow inverted triangle that is taller than the triangle representing the vertical surface 74. The apex of the shedding surface 76 triangle intersects with the leading base corner of the vertical surface 74 triangle. The trailing leg of the shedding surface 76 triangle intersects with the leading leg of the vertical surface 74 triangle to form a trailing shedding edge 78 of the shedding surface. An additional upper trailing edge portion 79 is formed by the intersection of the upper portion of the trailing leg of the shedding surface 76 triangle with the peripheral cylindrical surface of the tool.

As shown in FIGS. 4A and 4B, the base of the inverted shedding surface 76 triangle is formed by the intersection of the shedding surface and an upper shedding surface 80. The upper shedding surface is oriented diagonally downward, and is cut diagonally into the leading and inboard sides of the tool 20. The shedding and upper shedding surfaces 76, 80 together form a shallow V-shaped groove in the cutting tool.

The various cutting edges and blade surfaces cooperate as follows. As the tool advances through the helical cutting path, the leading cutting edge 56 cuts vertically into the drywall 12 while the bevel cutting edge 58 shaves away drywall material to form an outwardly extending bevel in the drywall. As represented by dashed arrows 82 in FIG. 4B, the shedding surface 76 channels substantially all drywall particles cut by the cutting edges 56, 58 upwardly along the shedding surface toward the upper shedding surface 80. As shown in FIG. 2, the upper shedding surface 80 usually remains exposed above the sheet of drywall during cutting, so that the cut drywall particles may fall by gravity away from the cutting tool 20.

Such continuous particle removal maintains the cutting edges 56, 58 and bevel and vertical surfaces 72, 74 substantially free from particle build-up during cutting. Thus, the tool cuts clean hole surfaces without a need for tool cleaning during cutting.

While the cutting tool is described as having a circular cross-section, it is to be understood that square, rectangular, and-other cross-sectional shapes will also work.

Once the tool 20 has been advanced to cut completely through the drywall sheet 12, the cutting apparatus may be manually pulled away from the drywall. As shown in FIG. 5, as the apparatus base 14 is pulled away, the base attachment screws 32 pull away a circular scrap of drywall 84 from within the circular beveled cut. In pulling away the scrap 84, the circular beveled hole 21 is opened in the sheet of drywall. The circular scrap 84 is detached from the apparatus base 14 and discarded or recycled.

As shown in FIG. 5, the beveled hole may then be filled by a pre-existing beveled plug 86 of drywall material. The plug has a circular diameter and a periphery 88 which is beveled along at least a portion thereof, and most preferably along the entire periphery to snugly register with the drywall 12 which defines the beveled hole 21. The plugs 86 may be produced in various sizes, corresponding to the variable cutting contour diameters 22 of FIG. 1, and for different patching situations. For instance, patches used for patching localized drywall damage will normally be solid. If the beveled hole 21 is formed around an electrical junction box or fixture 64, the plug 86 may be provided with a plug hole 90 having a corresponding size and shape. Patches may also be provided with pre-mounted hooks or the like. Once the plug 86 is snugly registered with the drywall surrounding the beveled hole 21, spackle or the like may be applied to conceal the seam between the plug and the sheet of drywall.

Because of the fit between the plug and the hole, very little spackling would be required to provide a smooth patched surface. The patched portion of the drywall is substantially as strong as an unpatched portion.

The apparatus is not limited to drywall repair applications. For example, it may be used for simply cutting holes in drywall or other surfaces to receive components, such as stereo speakers or other inset wall mounted devices.

This detailed description is set forth only for purposes of illustrating an example of the present invention and should not be considered to limit the scope of the claims to the invention in any way. Clearly, numerous additions, substitutions and modifications can be made to this example without departing from the scope of the invention. I claim any and all modifications which fall within the scope of the following claims.

I claim:

1. A method for repairing mounted sheets of wall surface material, comprising:

attaching a base to an exposed surface of the wall surface material at plural spaced locations such that said base is nonrotatable relative to said wall surface material, said base having a threaded shaft extending therefrom;

rotatably mounting a beveling blade support member on said threaded rod, the member having a blade extending from a distal end thereof to engage the exposed wall surface;

rotating the member so that the blade cuts a circular contour in the wall surface material; and progressively advancing the blade in a helical path into the wall surface material to cut a beveled hole in said wall surface material, said hole becoming narrower in cross-section moving away from said exposed surface.

2. The method according to claim 1, further comprising the step of limiting the distance that the blade may advance axially along the helical path so that the axial blade advancement is stopped before the blade substantially protrudes from the surface of the wall surface material opposite to the exposed surface.

3. The method according to claim 1, including the step of fitting a plug of material into the beveled hole, the plug having a beveled edge and a diameter to snugly register with the wall surface material boundary and defining the beveled hole.

4. The method according to claim 3, including the step of shaping the blade to shed substantially all particles of wall surface material cut by the blade from the blade while the blade is being advanced through the sheet of wall surface material.

5. A method according to claim 1 wherein the step of attaching a base to an exposed surface of the wall surface material comprises the step of attaching the base at plural spaced locations each spaced from the pivot axis.

6. A method of cutting holes in drywall or other wall surface material mounted over a wall framework or other underwall surface structure of a building, the wall surface material having an exposed major surface which is exterior to the underwall surface structure, the method comprising the steps of:

attaching a base to said exposed major surface of said wall surface material at plural spaced apart locations such that said base is nonrotatable relative to said wall surface material, said base having a threaded shaft extending therefrom;

rotatably mounting a blade support member on said threaded shaft, the member having a beveling blade extending from a distal end thereof to engage the exposed wall surface tracing a closed geometric path on the exposed major surface with blade to thereby penetrate the exposed major surface along the geometric path;

repeating the step of tracing a closed geometric path on the exposed major surface; and increasing the depth of penetration of the blade from the exposed major surface and into the wall surface material during repetitions of the tracing step to thereby helically extend the blade through the wall surface material and sever a piece of the wall surface material in the geometric shape and to leave a correspondingly shaped and beveled hole in the wall surface material, said hole becoming narrower in cross-sectional dimension moving from the exposed major surface toward the underwall surface structure.

7. A method according to claim 6 in which the closed geometric shape is a circle.

8. A method according to claim 6 including the step of patching the hole with a preformed patch of the geometric shape with at least a portion of the periphery of the preformed patch having a beveled edge which is shaped to abut the beveled edge of the hole and such that the beveled edge of the hole reinforces the patch when positioned in the hole.

9. A method according to claim 8 including the step of patching the hole with a preformed patch with a preformed opening formed therein which is sized and shaped for insertion of an electrical junction box therein.

10. A method according to claim 8 including the step of preforming the patch with a circular perimeter.

11. A method according to claim 10 in which the step of preforming the patch includes the step of preforming the patch with a preformed opening therein.

12. A method according to claim 8 including the step of preforming the patch with a preformed opening therein.

13. A method according to claim 6 wherein the step of attaching a base to an exposed surface of the wall surface material comprises the step of attaching the base at plural spaced locations each spaced from the pivot axis.

14. A method according to claim 6 in which the step of bevelling the hole comprises the step of bevelling the hole at an angle of from ten to fifteen degrees from a direction which is perpendicular to the exposed major surface.

15. A method according to claim 14 in which the base is attached to the wall surface material at four spaced apart locations.

16. The method according to claim 6 further comprising the step of limiting the distance that the blade may advance axially along the helical path so that the axial blade advancement is stopped before the blade substantially protrudes from the surface of the wall surface material opposite to the exposed surface.

17. An apparatus for repairing mounted sheets of wall surface material comprising:

a base adapted for coupling to an exposed surface of the wall surface material at plural spaced locations such that said base is nonrotatable relative to said wall surface material when mounted in place, said base having a pointed screw at each of said plural spaced locations, said screws being positioned to penetrate said wall surface material and secure said base to said wall surface material, said base having a threaded shaft extending therefrom;

a beveling blade support member having one end portion rotatably to said threaded shaft such that as the beveling blade support member is rotated in a first direction relative to the shaft, the beveling blade support member progressively advances in a helical path toward the wall surface material;

the beveling blade support member having a second end portion spaced from the threaded shaft, a beveling blade extending from the second end portion of the beveling blade support member and toward the exposed wall surface so as to engage the, exposed wall surface and cut a hole with a circular contour into the wall surface material, said hole becoming narrower in cross section moving away from said exposed surface, as the blade is advanced by rotating the beveling blade support member in the first direction.

18. An apparatus according to claim 17 further including a stop positioned to limit the distance that the beveling blade support member may advance axially along the helical path such that the blade advancement is stopped before the blade substantially protrudes from the surface of the wall surface material opposite to the exposed surface.

* * * * *